US007856821B2

(12) United States Patent
Katsuda et al.

(10) Patent No.: US 7,856,821 B2
(45) Date of Patent: Dec. 28, 2010

(54) ACTUATOR

(75) Inventors: Nobuyuki Katsuda, Tatsuno (JP); Kenji Numoto, Tatsuno (JP)

(73) Assignee: Daicel Chemical Industries, Ltd., Osaka (JP)

( * ) Notice: Subject to any disclaimer, the term of this patent is extended or adjusted under 35 U.S.C. 154(b) by 694 days.

(21) Appl. No.: 11/851,246

(22) Filed: Sep. 6, 2007

(65) Prior Publication Data

US 2008/0060512 A1 Mar. 13, 2008

Related U.S. Application Data

(60) Provisional application No. 60/826,332, filed on Sep. 20, 2006.

(30) Foreign Application Priority Data

Sep. 8, 2006 (JP) ..... 2006-243911

(51) Int. Cl.
*F01B 29/08* (2006.01)

(52) U.S. Cl. ..... 60/635; 60/636

(58) Field of Classification Search ..... 60/632–638
See application file for complete search history.

(56) References Cited

U.S. PATENT DOCUMENTS 3,125,851 A * 3/1964 Rubinstein et al. ..... 60/636
3,186,163 A * 6/1965 Dixon ..... 60/636
3,218,929 A * 11/1965 La Costa et al. ..... 89/1.51
3,261,261 A 7/1966 Brown
4,189,081 A * 2/1980 Combette et al. ..... 227/10
4,850,553 A * 7/1989 Takata et al. ..... 244/137.4

* cited by examiner

*Primary Examiner*—Hoang M Nguyen
(74) *Attorney, Agent, or Firm*—Birch, Stewart, Kolasch & Birch, LLP

(57) ABSTRACT

An actuator includes an ignition device having an igniter main body fixed to an igniter collar and a cylinder connected to the igniter collar. The cylinder has a first sliding chamber located in a position facing the ignition device and a second sliding chamber formed in a direction perpendicular to the first sliding chamber. A first piston is disposed inside the first sliding chamber, one end surface of the first piston having a first inclined surface inclined in one direction, and the other end surface opposing the ignition device, and a second piston is disposed inside the second sliding chamber. A circumferential surface of the second piston is provided with a recess formed with a second inclined surface inclining in the central axis direction, and the second piston is provided such that the first inclined surface abuts against the second inclined surface.

12 Claims, 3 Drawing Sheets

(a)

(b)

ACTUATOR

This nonprovisional application claims priority under 35 U.S.C. §119(a) on Patent Application No. 2006-243911 filed in Japan on 8 Sep. 2006 and 35 U.S.C. §119(e) on U.S. Provisional Application No. 60/826,332 filed on 20 Sep. 2006 which are incorporated by reference.

BACKGROUND OF INVENTION

1. Field of Invention

The present invention relates to an actuator for use in a restriction apparatus, for example, to lift a vehicle hood or pull a steering wheel.

2. Description of Related Art

In addition to airbag-type restraining devices that are used in occupant restraining devices and pedestrian protecting devices for vehicles, there also are apparatuses that lift a vehicle hood in order to protect a pedestrian during collision and apparatuses that pull in (pull in toward the front end of the vehicle) a steering wheel in order to protect the vehicle occupant during collision.

These apparatuses use a pyrotechnic actuator and are known to be of a type in which a pin (piston) is pushed out and a type in which a protruding pin (piston) is pulled in by actuation.

In any case, an ignition device including an igniting agent, such as an igniter, is used and a combustion product such as high-temperature gas or shock wave generated therefrom hit the pin or piston directly, thereby driving the pin (or piston).

In such an actuator, a combustion product for driving a piston (that is, a source of piston-driving energy) can be retained better and higher efficiency can be obtained by disposing an actuation portion of an igniter, where an ignition agent is accommodated, in the vicinity of a piston head. However, the actuator structure does not always allow the actuation portion to be disposed close to the piston head, and loss of combustion products sometimes occurs due to a bent conveying path before the combustion products reach the piston head.

FIG. 1 and FIG. 2 of U.S. Pat. No. 3,261,261 disclose an actuator. A cylinder 18 is formed in a neck portion 17, and a piston 23 is disposed therein. A piston rod 25 is attached to the piston 23, and the piston extends to the outside from a port 26 of the body 13. A squib port 28 is formed in the neck portion 17, and a squib 29 having an explosive agent 30 that is in contact with a bridge wire 31 is disposed therein. The axis of squib 29 is disposed at a right angle to the axis of the piston 23. The distal end (portion where the explosive agent is disposed) of the squib is disposed at a certain distance from the piston head 23.

With such configuration, a space is present inside the squib port and a space is present inside the cylinder 18, and a combustion product generated from the explosive diffuses in these spaces, which causes loss of the combustion product. As a result, it may be that the force that pushes the cylinder head 23 is reduced.

SUMMARY OF INVENTION

The present invention relates to an actuator including:

an ignition device having an igniter main body fixed to an igniter collar, a cylinder connected to the igniter collar, the cylinder having a first sliding chamber located in a position facing the ignition device and a second sliding chamber formed in a direction perpendicular to the first sliding chamber, a first piston being disposed inside the first sliding chamber, one end surface of the first piston having a first inclined surface inclined in one direction, and the other end surface being opposite to the ignition device, and a second piston being disposed inside the second sliding chamber, a circumferential surface of the second piston being provided with a recess formed with a second inclined surface inclining in the central axis direction, the second piston being provided such that the first inclined surface abuts against the second inclined surface.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF INVENTION

Figure 1:
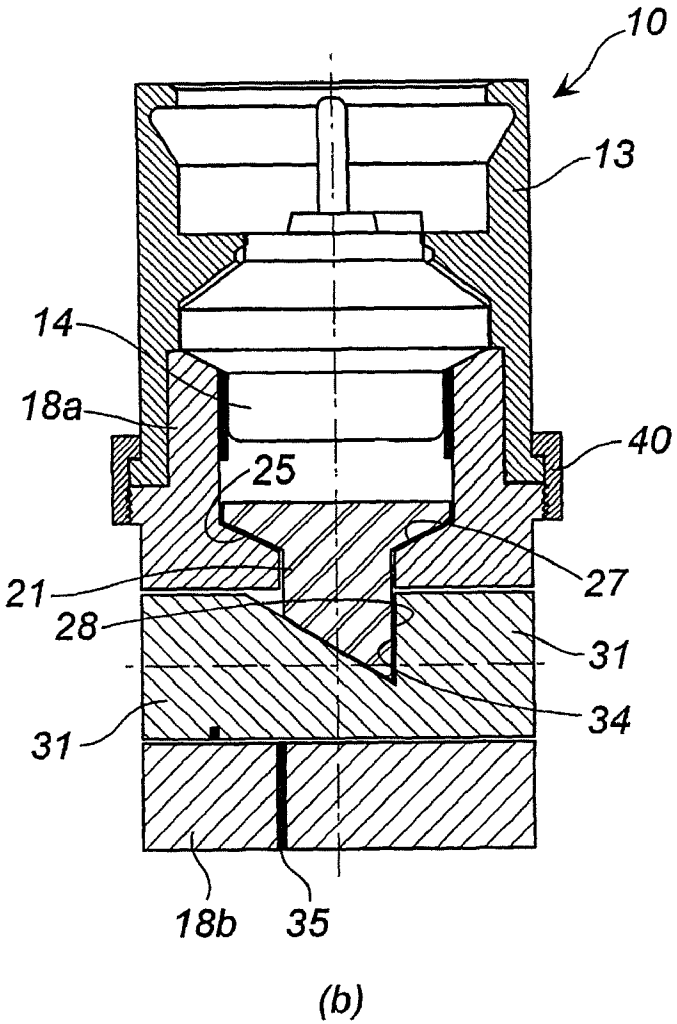
FIG. 1 shows a vertical sectional view of the actuator in accordance with the present invention; this figure serves to illustrate the operation of the actuator.
Figure 1:
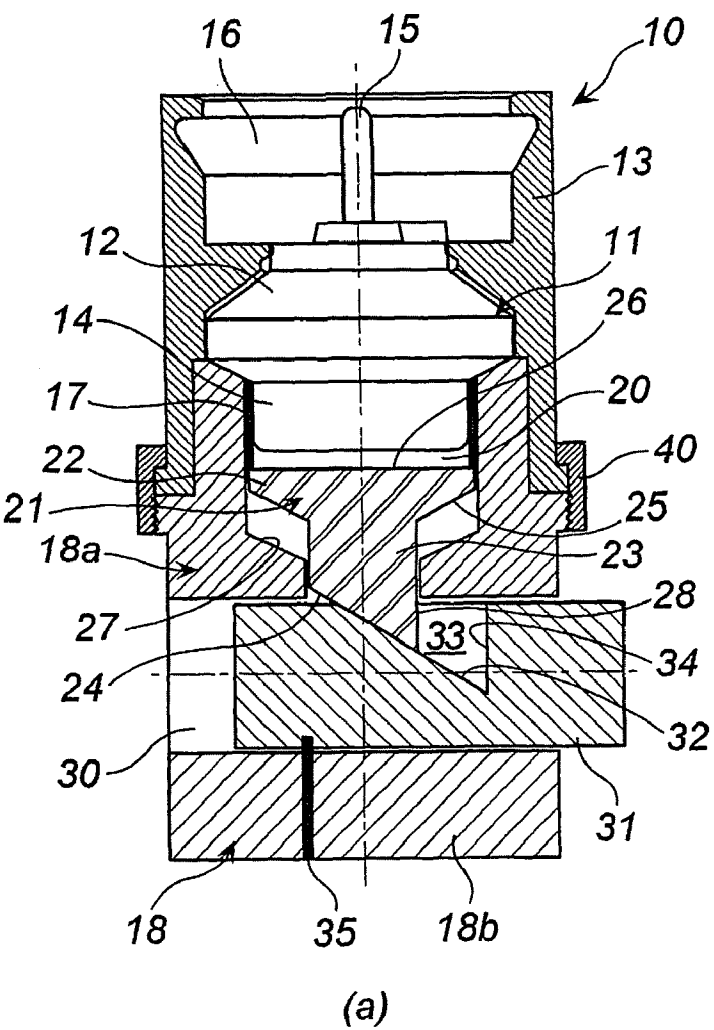

The present invention relates to an actuator that can transfer a combustion product to a piston and reliably actuate the piston, without a loss of the combustion product, even when the propagation direction of the combustion product generated from an ignition device differs from the sliding direction of the piston that is pushed in or out.

In the actuator of the present invention, the combustion product generated by the actuation of the ignition device is received only by a first piston that has an end surface facing the ignition device (preferably, an end surface that is directly opposite the ignition device), the second piston is pulled in or pushed out by receiving the siding movement of the first piston, without directly receiving the combustion product. Prior to actuation, the first piston and the second piston are in contact with each other.

As a result, the propagation direction of combustion products can be made different from the sliding direction of the second piston, and even in this case, loss of combustion products is almost completely prevented because most of the drive energy transferred from the combustion products to the first piston is transferred, via the first piston, to the second piston.

In the actuator in accordance with the present invention, the second piston can be pulled in or pushed out by adjusting the inclination direction of the first inclined surface of the first piston and the second inclined surface of the second piston.

The present invention further relates to the actuator, wherein the recess of the second piston has a second inclined surface that is inclined in the central axis direction and a vertical wall that is formed in a vertical direction with respect to the central axis from the deepest portion of the second inclined surface; and when the first inclined surface of the first piston slides along the second inclined surface of the second piston, the circumferential surface of the first piston comes into contact with the vertical wall of the second piston, thereby stopping the sliding of the first piston.

Accordingly, the sliding distance of the second piston can be adjusted to the desired length and, therefore, the pull-in or push-out length of the second piston can be easily adjusted.

The present invention further provides the actuator, wherein said one end surface of the first piston includes the first inclined surface shaped like an arrow head, the second sliding chamber includes therein two second pistons provided such that central axis of each of the two second pistons are parallel to each other and end surfaces thereof are opposite to each other, each of the two second pistons have the second inclined surface located from the end surface facing the end surface of the other piston, to a circumferential surface contacting with the end surface, and the two second pistons are provided such that the first inclined surface of the first piston abuts against each of the two second inclined surface.

In the actuator of the present invention, the combustion product generated by the actuation of the ignition device is received only by a first piston that has an end surface facing the ignition device (preferably, an end surface that is directly opposite to the ignition device), two second pistons are pushed out by receiving the siding movement of the first piston, without directly receiving the combustion product. Prior to actuation, the first piston and the two second pistons are in contact with each other.

As a result, the propagation direction of combustion product can be made different from the sliding direction of the two second pistons, and even in this case, loss of combustion product is almost completely prevented because most of the drive energy transferred from the combustion product to the first piston is transferred, via the first piston, to the two second pistons.

The present invention further relates to the actuator, wherein the first piston has a head portion, a rod portion with an outer diameter less than that of the head portion, and a first inclined surface formed at a distal end of the rod portion, and also has an annular step surface formed due to a difference in outer diameter between the head portion and the rod portion;

the first sliding chamber where the first piston is disposed has an annular inner wall surface in order to collide with the annular step surface; and when the first piston slides, the movement of the first piston is restricted by the annular step surface colliding with the annular inner wall surface.

Accordingly, the sliding distance of the first piston can be adjusted to the desired length and, therefore, the push-out length of the second piston can be easily adjusted.

The actuator in accordance with the present invention can reliably actuate the piston, without a loss of a combustion product, even when the propagation direction of the combustion product generated from an ignition device differs from the sliding direction of the piston that is pushed in or out.

Embodiments of Invention (1) Actuator of FIG. 1

FIGS. 1(*a*), (*b*) are vertical sectional views of an actuator. FIG. 1(*a*) shows a state before the actuation, and FIG. 1(*b*) shows a state after the actuation. The shape and size of the entire actuator 10 are determined according to the attachment object and attachment position.

An electric igniter 11 itself is a known igniter. An igniter main body 12 partially surrounded by a resin is inserted into a metal igniter collar 13, and part of the surface of the main body is fixed by abutting against a cylinder 18 (cylinder 18*a*). The reference numeral 14 stands for an ignition portion where an ignition agent is accommodated, 15 stands for an electroconductive pin, 16 stands for an insertion space for a connection plug for connecting to an external power source, and 17 stands for a spacer.

The cylinder 18 is made from a metal identical to that of the igniter collar 13 and is formed by integrating the cylinder 18*a* and cylinder 18*b*. The cylinder 18*a* forms a first sliding chamber 20 located in a position facing the igniter 11 (ignition portion 14), and a second sliding chamber 30 is formed by part of the wall surfaces of the cylinder 18*b* and cylinder 18*a*. The central axis of the first sliding chamber 20 and the central axis of the second sliding chamber 30 are perpendicular to each other.

A first piston 21 is disposed in the first sliding chamber 20. The first piston 21 has a head portion 22, a rod portion 23 that has an outer diameter less than that of the head portion 22 and a first inclined surface 24 formed to be inclined only in one direction at the distal end of the rod portion 23. The piston also has an annular step surface 25 formed by the difference in outer diameters between the head portion 22 and rod portion 23. An end surface 26 of the piston is located directly opposing the ignition portion 14 via a gap.

The first sliding chamber 20 has an annular inner wall surface 27 in order to collide with the annular step surface 25. Both the annular step surface 25 and the annular inner wall surface 27 have inclined surfaces of the same shape.

A second piston 31 is disposed in the second sliding chamber 30. A circumferential surface of the second piston 31 is provided with a recess 33 having formed therein a second inclined surface 32 that is inclined in the central axis direction. The recess 33 has a vertical wall 34 that is formed in the vertical direction with respect to the central axis from the deepest portion of the second inclined surface 32.

The igniter collar 13 and cylinder 18 (cylinder 18*a*) are connected and integrated, as shown in the drawing, by engaging a short flange of the opening of the igniter collar 13 with an opening in one side of an annular tightening member 40 and screwing together the outer circumferential surface of the cylinder 18*a* and the inner circumferential surface of the annular tightening member 40.

A resin shear pin 35 that is a member for preventing the second piston 31 form moving prior to actuation is embedded in the thickness direction in the wall surface of the cylinder 18*b* forming an outer wall of the second sliding chamber 30, and the distal end portion of the shear pin is inserted into a hole formed in the circumferential surface of the second piston 31 disposed inside the second sliding chamber 30. Under the action of the shear pin 35, erroneous actuation in which the second piston 31 slides before the igniter 11 is actuated is prevented.

Part of the first inclined surface 24 at the distal end of the first piston abuts against the second inclined surface 32 of the circumferential surface of the second piston.

The operation of actuator 10 will be explained below with reference to FIGS. 1(*a*), (*b*). When the igniter 11 is actuated, a generated combustion product collides with the end surface 26 of the first piston. As a result, the first piston 21 slides in the axial direction inside the first sliding chamber 20.

At this time, the first inclined surface 24 at the distal end of the first piston pushes the second inclined surface 32 at the circumferential surface of the second piston, while sliding on the second inclined surface, and causes the second piston 31 to slide. As a result, the shear pin 35 is broken, and the second piston 31 slides to be pulled into the second sliding chamber 30.

Then, the annular step surface 25 of the first piston collides with the annular inner wall surface 27 of the first sliding chamber, and at the same time the circumferential surface 28 of the first piston collides with the vertical wall 34 of the recess 33, whereby sliding of the second piston 31 is stopped in a state in which the second piston is completely pulled into the second sliding chamber 30.

In the actuator 10, the combustion product generated by the actuation of the igniter 11 is received only by the first piston 21, but because the first piston is in a state of contact with the second piston 31 prior to actuation, the combustion product received by the first piston 21 is substantially retained and transmitted to the second piston 31. As a result, although the ejection direction of combustion product is different from the sliding direction of the second piston, the loss of combustion products can be reduced to a minimum, and reliable actuation can be ensured.

Figure 2:
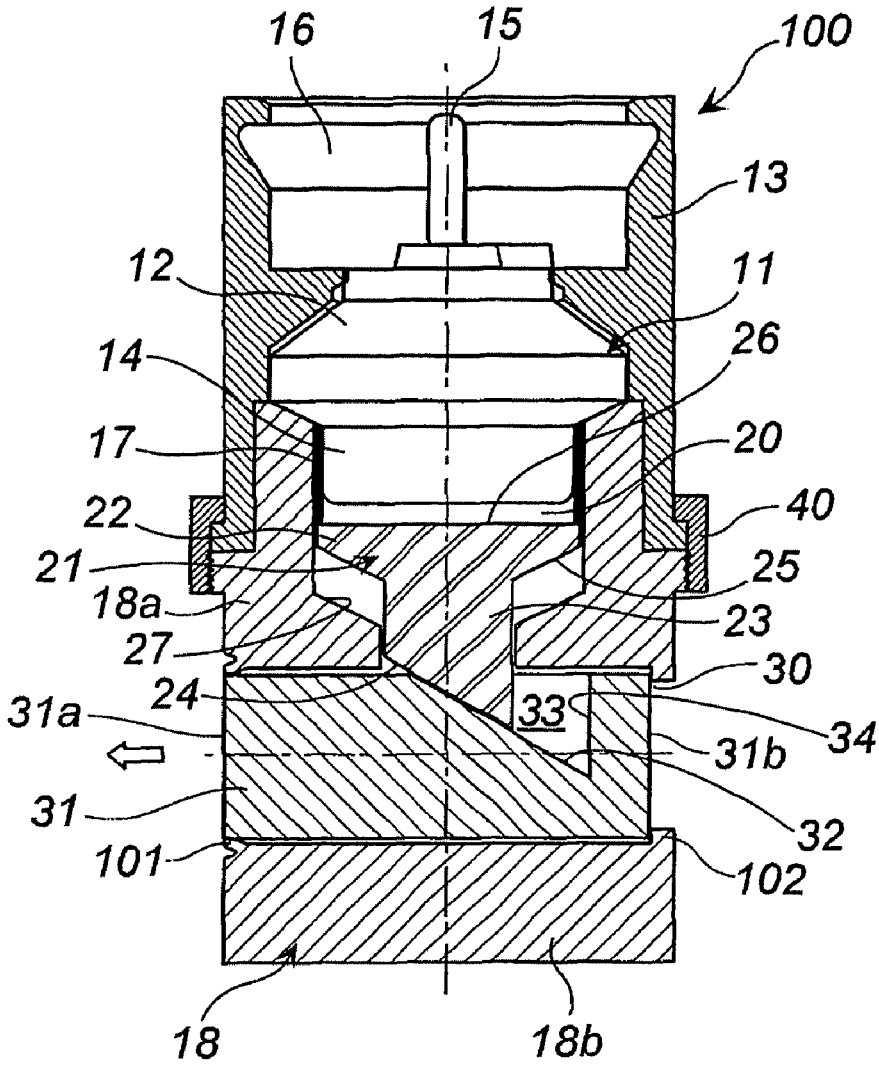
FIG. 2 shows a vertical sectional view of the actuator of another embodiment.

(2) Actuator of FIG. 2

FIG. 2 is a vertical sectional view of an actuator of another embodiment. An actuator 100 of FIG. 2 has a structure almost identical to that of the actuator 10 shown in FIG. 1, and the reference numerals identical to those in FIG. 1 mean identical structural elements.

In the actuator 100, as shown in the drawing, prior to actuation, a second piston 31 is entirely accommodated inside a second sliding chamber 30. Therefore, in the actuator 100, first movement preventing means 101 and second movement preventing means 102 are provided in openings at both ends of the second sliding chamber 30, instead of the shear pin 35 that serves as the movement preventing means for a second piston 31 in the actuator 10 shown in FIG. 1.

The first movement preventing means 101 has an annular protrusion or a plurality of independent protrusions that protrude from the opening at one end of the second sliding chamber 30, and the protruding portion holds a second piston end surface 31*a* and prevents the second piston from moving in the axial direction. The first movement preventing means 101 can prevent the second piston 31 from moving prior to actuation, but the strength of the first movement preventing means is such that this means can be fractured or deformed easily at the time of the actuation, thereby allowing the second piston 31 to slide.

The second movement preventing means 102 has an annular protrusion or a plurality of independent protrusions that protrude from the opening at the other end of the second sliding chamber 30, and the protruding portion holds a second piston end surface 31*b* and prevents the second piston from moving in the axial direction. Because the second piston 31 slides in the direction shown by the arrow in FIG. 2 upon actuation, the second movement preventing means 102 has a strength such that the means is not fractured during actuation, to prevent completely the movement of the second piston 31 in the opposite direction.

The second actuator 100 in FIG. 2 operates in the same manner as the actuator 10, except that when the igniter 11 is actuated, instead of breaking the shear pin 35 of the actuator 10 shown in FIG. 1, the first movement preventing means 101 is broken and the second piston 31 is forced to protrude to the outside from the second sliding chamber 30.

Figure 3:
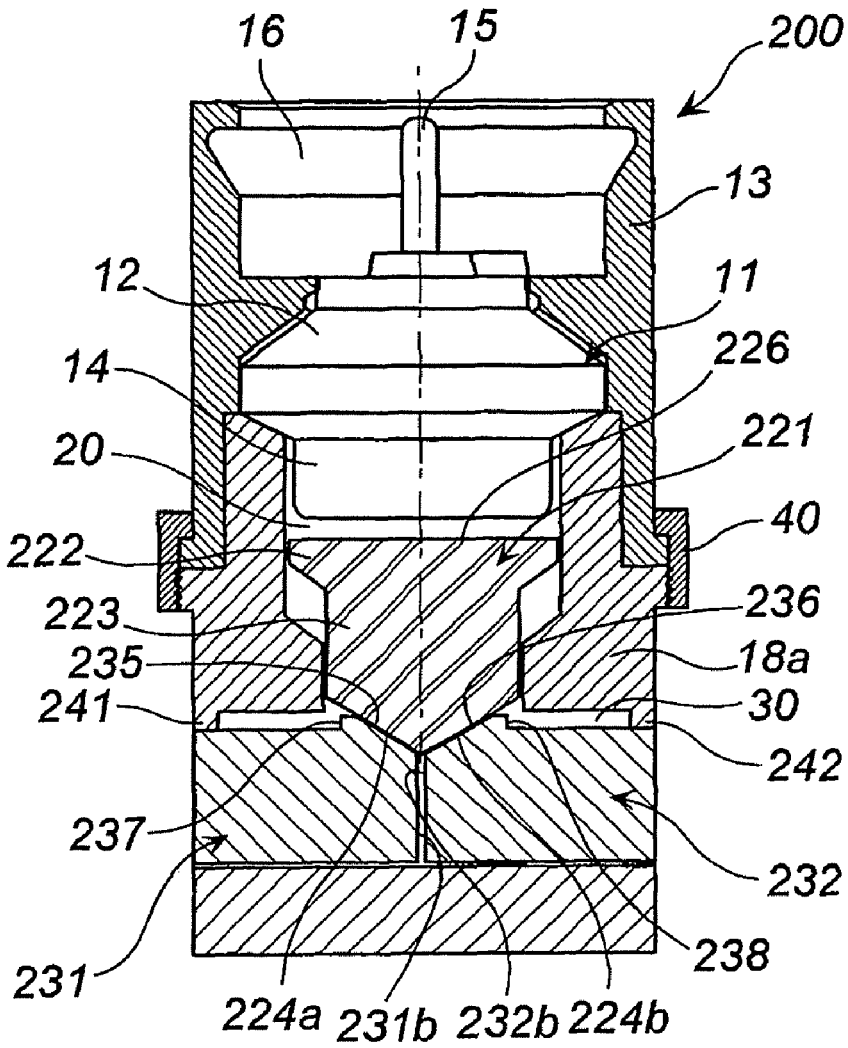
FIG. 3 shows a vertical sectional view of the actuator of still another embodiment.

(3) Actuator of FIG. 3

FIG. 3 is a vertical sectional view of an actuator of yet another embodiment. An actuator 200 of FIG. 3 has a structure almost identical to that of the actuator 10 shown in FIG. 1, except that the shapes of the first piston and second piston are different and two second pistons are provided; here, the reference numerals identical to those in FIG. 1 indicates the identical structural elements.

A first piston 221 located inside a first sliding chamber 20 has a head portion 222, a rod portion 223 with an outer diameter less than that of the head portion 222, and a first A inclined surface 224*a* and a first B inclined surface 224*b* that are formed to have an arrow head shape at the distal end of the rod portion 223. The first A inclined surface 224*a* and first B inclined surface 224*b* are inclined surfaces that are symmetrical with respect to the central axis.

A second A piston 231 and a second B piston 232 are disposed inside the second sliding chamber 30 so that the central axes of the pistons coincide with each other. An end surface 231*b* and end surface 232*b* of the pistons are directly opposing each other via a gap.

The second A piston 231 has a second A inclined surface 235 formed from an end surface 231*b* to the circumferential surface and a first step portion 237 formed due to a difference in outer diameter in the axial direction at the circumferential surface. The second B piston 232 has a second B inclined surface 236 formed from an end surface 232*b* to the circumferential surface and a second step portion 238 formed due to a difference in outer diameter in the axial direction at the circumferential surface.

The first A inclined surface 224*a* and a first B inclined surface 224*b* of the first piston 221 are in contact with the second A inclined surface 235 of the second A piston 231 and the second B inclined surface 236 of the second B piston 232.

In the wall surface of the cylinder 18*a* that forms the second sliding chamber 30, a first protrusion 241 is formed in the opening at one end of the second sliding chamber 30, and a second protrusion 242 is formed in the opening at the other end.

A shear pin 35 shown in FIG. 1 can be used as means for preventing the second pistons 231 and 232 from moving prior to actuation.

The operation of the actuator 200 will be described below with reference to FIG. 3. When the igniter 11 is actuated, the combustion product collides with the first piston end surface 226, and as a result, the first piston 221 moves in the axial direction inside the first sliding chamber 20.

At this time, because the first A inclined surface 224*a* and first B inclined surface 224*b* of the distal end of the first piston are pushed against two surfaces, namely, the second A inclined surface 235 and second B inclined surface 236 of the second piston, while sliding on these surfaces, the second A piston 231 and second B piston 232 slide to protrude at each side from the second sliding chamber 30.

Then, the first step portion 237 of the second piston collides with the first protrusion 241, and the second step portion 238 of the second piston collides with the second protrusion 242, whereby the sliding of the second A piston 231 and second B piston 232 is stopped in a state in which portions of a predetermined length are ejected from the second sliding chamber 30.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An actuator, comprising:

an ignition device having an igniter main body fixed to an igniter collar;

a cylinder connected to the igniter collar, the cylinder having a first sliding chamber located in a position facing the ignition device and a second sliding chamber formed in a direction perpendicular to the first sliding chamber;

a first piston disposed inside the first sliding chamber, one end surface of the first piston having a first inclined surface inclined in one direction, and the other end surface opposing the ignition device; and a second piston disposed inside the second sliding chamber, a circumferential surface of the second piston being provided with a recess formed with a second inclined surface inclining in a central axis direction, the second piston being provided such that the first inclined surface abuts against the second inclined surface, wherein, upon activation of the actuator, the first piston moves relative to the second piston, such that the first inclined surface slides on the second inclined surface to push the second piston in an axial direction of the second sliding chamber.

2. The actuator according to claim 1, wherein the recess of the second piston is defined by the second inclined surface and a vertical wall that is formed in a vertical direction with respect to a central axis of the second piston from the deepest portion of the second inclined surface; and when the first inclined surface of the first piston slides along the second inclined surface of the second piston, the circumferential surface of the first piston comes into contact with the vertical wall of the second piston, thereby stopping the sliding of the first piston.

3. The actuator according to claim 1, wherein said one end surface of the first piston includes the first inclined surface shaped like an arrow head, the second sliding chamber includes therein two second pistons provided such that central axis of each of the two second pistons are parallel to each other and end surfaces thereof oppose each other, each of the two second pistons have the second inclined surface located from the end surface facing the end surface of the other piston, to a circumferential surface contacting with the end surface, and the two second pistons are provided such that the first inclined surface of the first piston abuts against each of the two second inclined surfaces.

4. The actuator according to claim 1, wherein the first piston has a head portion, a rod portion with an outer diameter less than that of the head portion, and the first inclined surface formed at a distal end of the rod portion, and also has an annular step surface formed due to a difference in outer diameter between the head portion and the rod portion;

the cylinder defining the first sliding chamber where the first piston is disposed has an annular inner wall surface that collides with the annular step surface; and when the first piston slides, the movement of the first piston is restricted by the annular step surface colliding with the annular inner wall surface.

5. The actuator according to claim 2, wherein the first piston has a head portion, a rod portion with an outer diameter less than that of the head portion, and the first inclined surface formed at a distal end of the rod portion, and also has an annular step surface formed due to a difference in outer diameter between the head portion and the rod portion;

the cylinder defining the first sliding chamber where the first piston is disposed has an annular inner wall surface that collides with the annular step surface; and when the first piston slides, the movement of the first piston is restricted by the annular step surface colliding with the annular inner wall surface.

6. The actuator according to claim 1, further comprising:

a shear pin that extends into the second sliding member and engages with the second piton to prevent movement of the second piston prior to activation of the actuator.

7. The actuator according to claim 1, wherein the cylinder defining the second sliding chamber is provided with first movement preventing means and second movement preventing means that prevent the second piston from moving in an axial direction of the second piston prior to activation of the actuator, said first movement preventing means allows movement of the second piston upon activation of the actuator.

8. The actuator according to claim 3, wherein said cylinder defining the second sliding chamber has a first protrusion and a second protrusion that protrude into the second sliding chamber at both ends thereof to prevent the two second pistons from moving prior to activation of the actuator.

9. The actuator according to claim 1, wherein said cylinder and said igniter collar are made from a same metal.

10. The actuator according to claim 1, further comprising:

a tightening member that connects the igniter collar to the cylinder.

11. The actuator according to claim 1, wherein the first inclined surface continues to abut against the second inclined surface prior to and after activation of the actuator.

12. An actuator, comprising:

an ignition device having an igniter main body fixed to an igniter collar;

a cylinder connected to the igniter collar, the cylinder having a first sliding chamber located in a position facing the ignition device and a second sliding chamber formed in a direction perpendicular to the first sliding chamber;

a first piston disposed inside the first sliding chamber, one end surface of the first piston having a first inclined surface inclined in one direction, and the other end surface opposing the ignition device; and a second piston disposed inside the second sliding chamber, a circumferential surface of the second piston being provided with a recess formed with a second inclined surface inclining in a central axis direction, the second piston being provided such that the first inclined surface abuts against the second inclined surface, wherein said one end surface of the first piston includes the first inclined surface shaped like an arrow head, the second sliding chamber includes therein two second pistons provided such that central axis of each of the two second pistons are parallel to each other and end surfaces thereof oppose each other, each of the two second pistons have the second inclined surface located from the end surface facing the end surface of the other piston, to a circumferential surface contacting with the end surface, and the two second pistons are provided such that the first inclined surface of the first piston abuts against each of the two second inclined surfaces.

* * * * *